United States Patent [19]

Moyski et al.

[11] 4,148,478

[45] Apr. 10, 1979

[54] EXERCISER APPARATUS

[75] Inventors: John G. Moyski, Denver; Horst W. Mueller, Erie, both of Colo.

[73] Assignee: Chaparral Industries, Incorporated, Denver, Colo.

[21] Appl. No.: 759,355

[22] Filed: Jan. 14, 1977

[51] Int. Cl.[2] ..... A63B 69/16

[52] U.S. Cl. ..... 272/73

[58] Field of Search ..... 272/73; 128/25 R; 280/293, 295, 299; 211/17, 22; 188/83, 74

[56] References Cited

U.S. PATENT DOCUMENTS

| | | | |
|---|---|---|---|
| 648,551 | 5/1900 | Gottrell | 272/73 |
| 1,387,771 | 8/1921 | Eklund | 280/261 |
| 1,647,494 | 11/1927 | Zanellato | 280/261 |
| 1,744,607 | 1/1930 | Baine | 272/73 |
| 2,238,295 | 4/1941 | Snyder | 272/73 |
| 2,320,489 | 6/1943 | Turner et al. | 272/73 X |
| 2,388,777 | 11/1945 | Wentz | 272/73 |
| 2,468,933 | 5/1949 | Jones | 280/261 X |
| 2,668,709 | 2/1954 | Boyko | 272/73 X |
| 3,100,640 | 8/1963 | Weitzel | 272/73 |
| 3,259,385 | 7/1966 | Boren | 272/73 |
| 3,477,741 | 11/1969 | Ross | 280/279 |
| 3,664,027 | 5/1972 | Fritz et al. | 272/73 X |
| 3,727,608 | 4/1973 | Simsian | 272/73 X |
| 3,849,008 | 11/1974 | Boucher et al. | 403/110 |

FOREIGN PATENT DOCUMENTS

| | | | |
|---|---|---|---|
| 2023131 | 11/1970 | Fed. Rep. of Germany | 272/73 |
| 2238585 | 2/1974 | Fed. Rep. of Germany | 272/73 |
| 260428 | 9/1928 | Italy | 188/83 |
| 21582 of | 1905 | United Kingdom | 272/73 |
| 396334 | 8/1933 | United Kingdom | 272/73 |
| 407263 | 3/1934 | United Kingdom | 272/73 |
| 432220 | 7/1935 | United Kingdom | 272/73 |
| 479945 | 2/1938 | United Kingdom | 272/73 |
| 767613 | 2/1957 | United Kingdom | 272/73 |
| 936469 | 9/1963 | United Kingdom | 272/73 |

OTHER PUBLICATIONS

Popular Science, Oct. 1962, p. 56, Trim Ride 600 by AMF Whitley.

*Primary Examiner*—William H. Grieb
*Assistant Examiner*—Arnold W. Kramer
*Attorney, Agent, or Firm*—John E. Reilly

[57] ABSTRACT

An exerciser apparatus is made up of front and rear base-mounted standards interconnected by a common intermediate frame having an adjustable seat portion and a pedal crank assembly beneath the seat portion which is provided with an adjustable brake to control the resistance to rotation of the pedal crank which is imparted through a V-belt drive into a front wheel mounted on the front standard. A speedometer senses the speed of rotation of the front wheel in response to rotation of the pedal crank assembly.

13 Claims, 6 Drawing Figures

EXERCISER APPARATUS

BACKGROUND OF THE INVENTION

This invention relates to exercising apparatus and more particularly relates to indoor exercisers of the type which simulate bicycling and which are customarily referred to as "exercycles" or exercise cycles.

Various types of exercising devices have been devised to the end of providing some means of indoor exercise which will closely simulate outdoor forms of exercise. A popular indoor form of exercising apparatus is the exercise cycle which will essentially permit a person to pedal in place and through a speedometer reading taken off of a front wheel mounting determine the speed of rotation and distance. Typical of such exercising apparatus are those disclosed in the U.S. Patents to Baine No. 1,744,607 and to Snyder No. 2,238,295 in which a seat portion, pedal crank assembly and front wheel are mounted on a stand so that the rider can by rotating the pedal crank assembly effect the same exercise as in riding a bicycle. Further, as disclosed in the Snyder patent, rotation of the pedal crank assembly is imparted through a chain drive to a front wheel to which is connected a speedometer so as to permit the rider to determine his speed of rotation. In addition, varying degrees of resistance to rotation can be imparted through a tension controlling device which will impose a varying amount of resistance to rotation by varying its pressure against the outer surface of the wheel, as typified by the patents to Baine and Snyder. Other approaches have been taken to apply varying degrees of tension or resistance to rotation, such as, that disclosed in German Pat. No. 2,023,131 where a pedal crank assembly is employed without a separate front wheel and variable resistance to rotation is provided through a cable trained over a pulley and where the cable may be regulated in tension to resist rotation of the pulley. Other forms of exercising apparatus designed for leg or limb exercising which do not employ a separate pedal crank operating through a front wheel is represented by U.S. Patent No. to Weitzel No. 3,100,640 in which foot pedals are affixed directly to a rotating member and the tension or resistance to rotation is adjustably controlled by means of a brake member secured to one end of the hub or center shaft of the rotating member. The latter approach has not been as favorably received as the exercycle in that it does not simulate riding of a bicycle and does not afford a means for the exerciser to determine accurately either the rate of speed at which he is pedaling or the "distance" or mileage which can be determined from the speed of rotation over a given time interval.

In known forms of exercising apparatus, as generally represented by the patents to Snyder and Baine, the tension control devices employed are not readily accessible to the rider or exerciser. Further, such devices impose resistance on the outer surface of the wheel and therefore are subject to wear and uneven resistance to rotation. In any event it has been discovered that braking or resistance to rotation can be made more accessible to the rider by imposing such resistance directly upon the crankshaft of the pedal crank assembly. At the same time, an improved power transmission drive can be employed for imparting rotation from the pedal crank assembly into the front wheel which is quiet but very durable and which is in part attributable to removing the tension control from the wheel itself and applying it to the pedal crank assembly so that the power transmission drive is not operating against the resistance imposed on the front wheel by a brake member. Moreover, it is desirable to provide a simplified but greatly unified assembly in which a single U-shaped frame is suspended between a pair of front and rear standards so as to afford a greatly simplified but more rigid type of mounting for the seat portion, pedal crank assembly and front wheel.

SUMMARY OF THE INVENTION

It is therefore an object of the present invention to provide for a novel and improved stationary exercising apparatus of a type which has the characteristics of a bicycle.

It is another object of the present invention to provide in an exercising apparatus simulating the riding characteristics of a bicycle for an improved brake assembly capable of adjustably controlling resistance to rotation directly through the pedal crank assembly of the apparatus.

A further object of the present invention is to provide in a stationary exercising apparatus for a novel and improved stand for suspending a pedal crank assembly and front wheel which is comprised of a minimum number of parts unified into a rigid mounting structure which is subject to minimum wear and misalignment notwithstanding repeated use.

It is an additional object of the present invention to provide in an exercising apparatus of the exercycle type which employs a novel and improved form of power transmission between a pedal crank assembly and front wheel which is extremely quiet in operation but will permit accurate reading of speed and distance.

In accordance with the present invention, a preferred embodiment thereof is comprised of a stand having a base support member and a frame extending upwardly from the base support for the purpose of suspending a front wheel and pedal crank assembly, the latter including a crank shaft beneath the seat portion in a unified arrangement. A power transmission drive transmits the rotation of the pedal crank assembly into the front wheel, and a braking member includes a brake surface adapted to frictionally engage the crankshaft with means to adjustably control the amount of pressure applied by the brake surface against the crankshaft, the control being conveniently accessible to the rider or exerciser so that one can regulate the degree of resistance to rotation.

In the preferred form, the base support takes the form of a stand having front and rear base-mounted standards between which extends a single, generally U-shaped frame in such a way that the seat portion can be mounted at the rearward end of the frame and the pedal crank affixed to the lower closed end of the frame directly behind the front wheel assembly. Rotation of the pedal crank assembly is imparted to the front wheel through an endless V-belt trained about a drive pulley on the pedal crank assembly and a driven pulley on the front wheel hub so as to minimize the noise otherwise associated with chain or other positive drives which have been employed in the past between the pedal crank assembly and the front wheel. This is made possible to a great extent by utilization of a braking member in direct association with the pedal crankshaft so that the resistance to rotation is applied directly to the pedal crank assembly, as opposed to braking members which in the past have been associated with the outer rim or hub of the front wheel. In other words, it is not necessary to impart rotation into the front wheel against the resistance normally imposed by a braking member and which otherwise requires the utilization of a chain or other positive drive. In addition, the front standard or base support is so arranged as to provide a rigid mounting for the front wheel as well as for the handlebar unit.

BRIEF DESCRIPTION OF THE DRAWINGS

The above and other objects, advantages and features of the present invention will become more readily appreciated and understood from the following detailed description when taken together with the accompanying drawings, in which.

DETAILED DESCRIPTION OF THE PREFERRED EMBODIMENT

Figure 1:
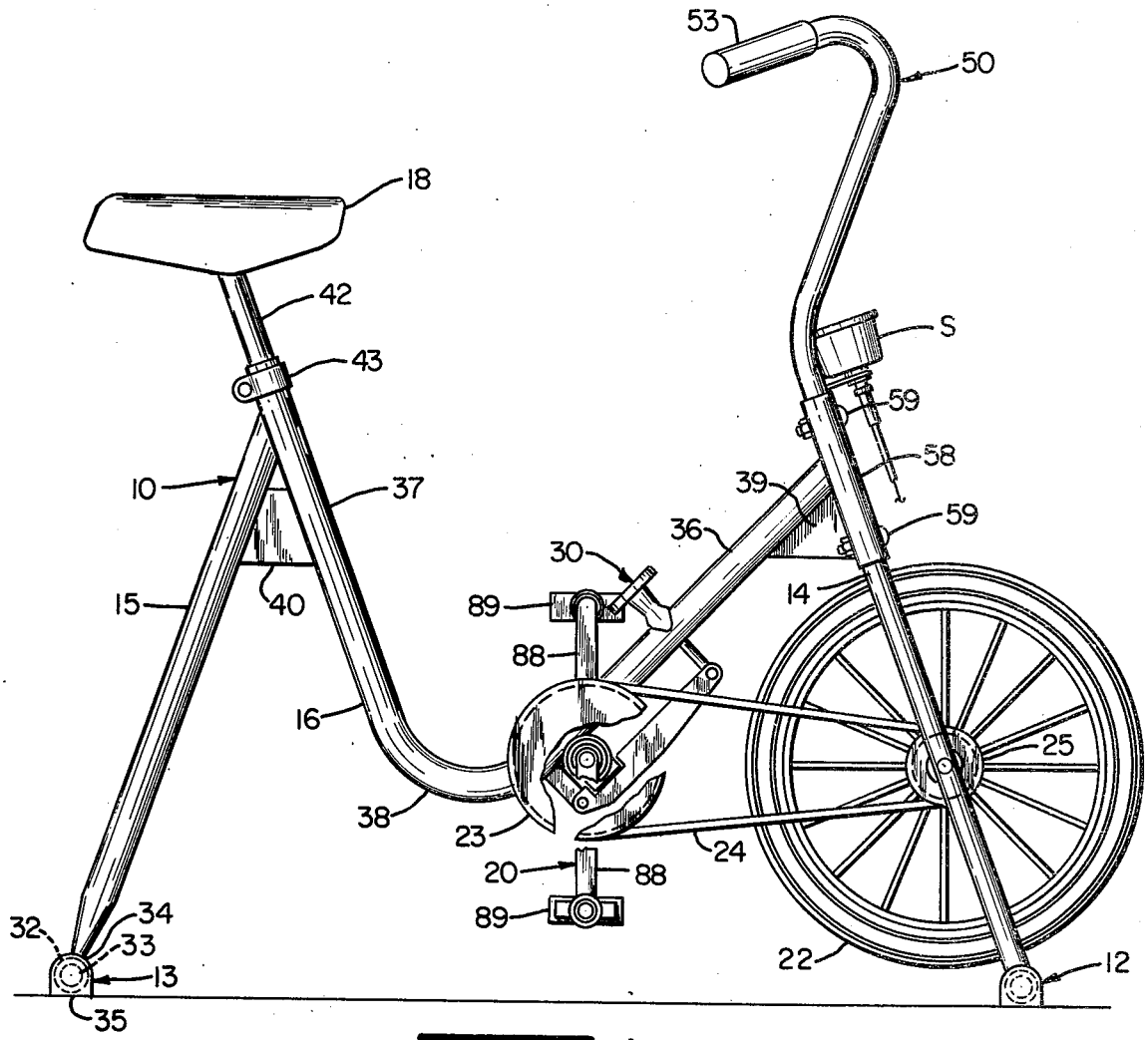
FIG. 1 is a side elevational view of a preferred form of the present invention.

Referring in detail to the drawings, there is illustrated in FIGS. 1 to 6 a preferred form of exerciser apparatus 10 which is broadly comprised of base support means in the form of front and rear base support members 12 and 13, respectively, and a frame extending upwardly from said base support means in the form of a front standard 14, a rear standard 15 and an intermediate U-shaped frame portion 16 joining the front and the rear standard portions. A seat portion 18 is adjustably mounted on the intermediate frame 16 and a pedal crank assembly 20 is also affixed to the frame beneath the seat portion. A front rotatable wheel member 22 is journaled for rotation on the front standard in spaced relation above the front ground-engaging pad 12 and is rotated by power transmission means in the form of a drive pulley 23 on the pedal crank assembly which imparts rotation through an endless power transmission belt 24 to a driven pulley 25 on the front wheel 22. In addition, an adjustable brake unit 26 is associated with the pedal crank assembly and in accordance with the present invention is characterized by a brake pad 27 which is adjustably mounted with respect to the pedal crankshaft by a pivotal brake arm member 28 and adjustable control means 30. In a manner hereinafter described in more detail, the adjustable control means 30 can be regulated by the rider or exerciser from a position seated on the apparatus to control the degree of resistance to rotation of the pedal crank assembly and therefore to regulate the amount of work required to rotate the pedal crank assembly and impart such rotation into the front wheel. A conventional speedometer assembly S senses the speed of rotation of the front wheel to record same in miles/per/hour and, if desired, may also include an odometer to record distance of travel.

Figure 2:
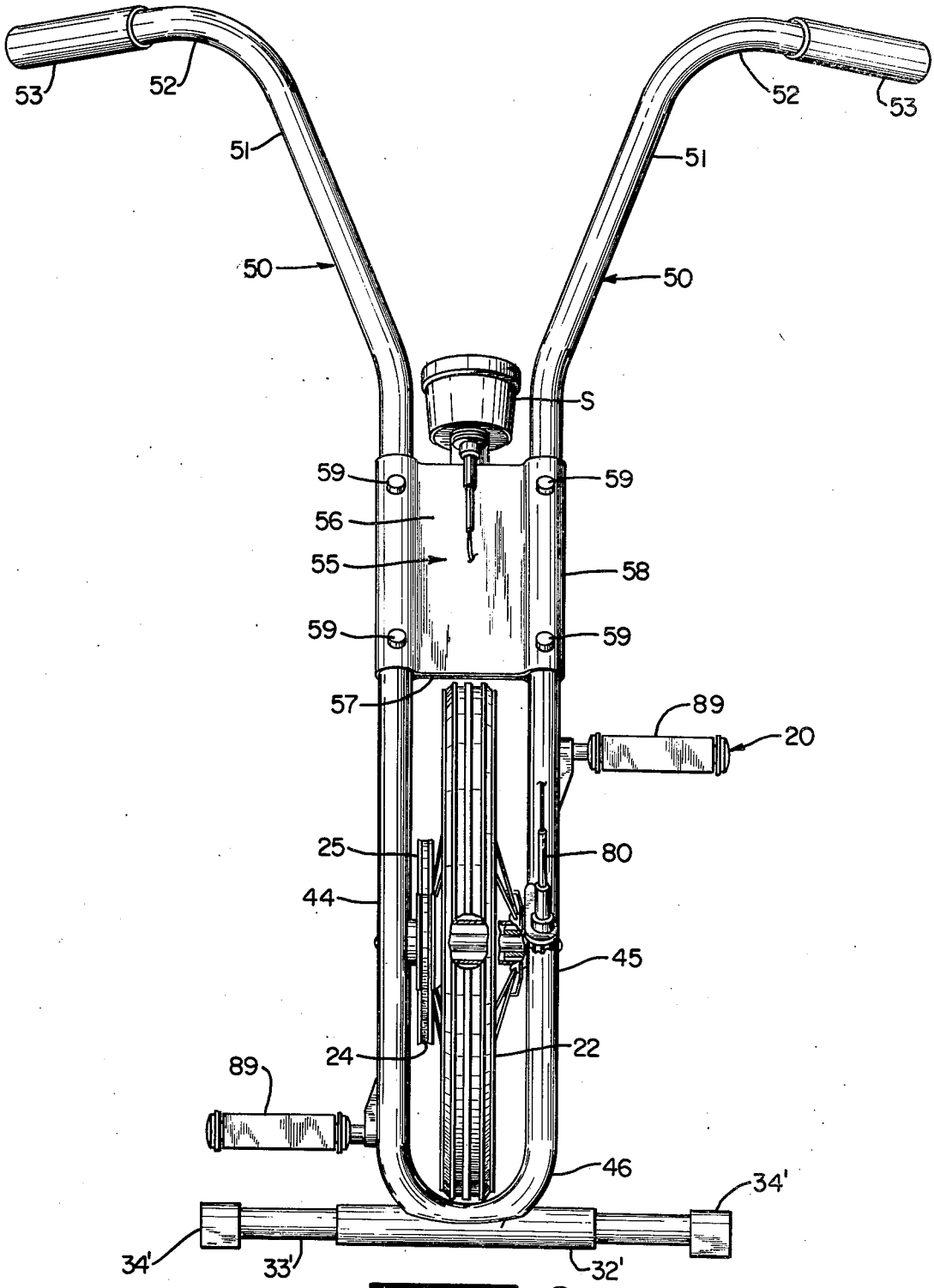
FIG. 2 is a front view of the preferred form of invention shown in FIG. 1.

Considering in more detail the construction and arrangement of the preferred form of exercising apparatus the rear standard 15 is defined by a downwardly and rearwardly inclined post which, in a manner corresponding to that illustrated in FIG. 2 with respect to the front base support member 12, has a transverse brace member at its lower end comprised of a sleeve or tube 32 welded to its lower end into which is inserted a crossbar 33. A ground-engaging pad or foot 34 is placed over each end of the crossbar 33 having a relatively broad, flat base surface 35 to permit flush engagement with the floor or ground surface.

The intermediate frame 16 is preferably of a generally V-shaped configuration having a forwardly and upwardly inclined leg 36 and rearwardly and upwardly inclined leg 37 from a common lower closed end portion 38, the rearwardly directed leg 37 being rigidly joined to the upper end of the post or standard 15 by a gusset 40. In addition, the intermediate frame is preferably of a hollow or tubular configuration, the upper open end of the leg 37 adapted to permit insertion of the post 42 of the seat portion 18 with an adjustable collar 43 adapted to permit height adjustment of the post and attached seat portion 18. The seat 18 is conventionally in the form of a saddle which may also be independently adjustable with respect to the post all in a well known manner. The front leg 36 inclines forwardly and upwardly at a more gradual angle than the rear leg and is welded to the front standard 14 along with gusset 39 so as to form a rigid, unitary frame assembly.

As best seen from FIG. 2, the front standard 14 is comprised of an elongated generally U-shaped tube having legs 44 and 45 in closely spaced, parallel relation to one another extending upwardly from a lower closed end 46 which is affixed to the tube 32', the latter receiving a shaft 33' with ground-engaging feet or pads 34' at each end corresponding to the base support member 13 at the lower end of the rear standard 15. Opposite parallel legs 44 and 45 each continue upwardly into a handlebar unit 50 wherein each handlebar unit has a somewhat forwardly and laterally divergent section 51 forming a continuation of one of the legs 44 and 45 and terminating in a rearwardly divergent horizontally extending portion 52 adapted to receive a handle grip 53. The front standard 14 is further rigidified by a clamping unit 55 consisting of front and rear brackets 56 and 57, respectively, the rear bracket being welded to the upper extremity of the front leg 36 of the frame. Each bracket 56 and 57 has arcuate leg-engaging portions 58 along opposite lateral edges secured in place to the legs 44 and 45 by fasteners 59, each fastener 59 preferably taking the form of a bolt passed through aligned openings in opposite sides 58 of the front and rear brackets and threadedly receiving nuts.

The front wheel 22 is of conventional construction and comprises an outer wheel rim 60 for a rubber tire 61 and radial spokes 62 extending outwardly from wheel hub 64 into the outer wheel rim 60. The wheel hub 64 is disposed in outer spaced concentric relation to shaft 66 by a nylon bearing or spacer 67 at one end and a hub 68 of pulley 25 at the opposite end, there being an annular splined ring 69 interposed in the space between the respective outer surfaces of the spacer 67 and hub 68 and the inner surface of the wheel hub 64. In addition the shaft 66 is drilled and tapped at opposite ends for threaded insertion of mounting screws 70 which are passed through transverse openings 71 in the legs 44 and 45 of the form tube. The pulley 25 is provided with a generally V-shaped groove 74 which is adapted to receive the endless V-belt 24 in order to impart rotation to the front wheel about the shaft 66.

Figure 5:
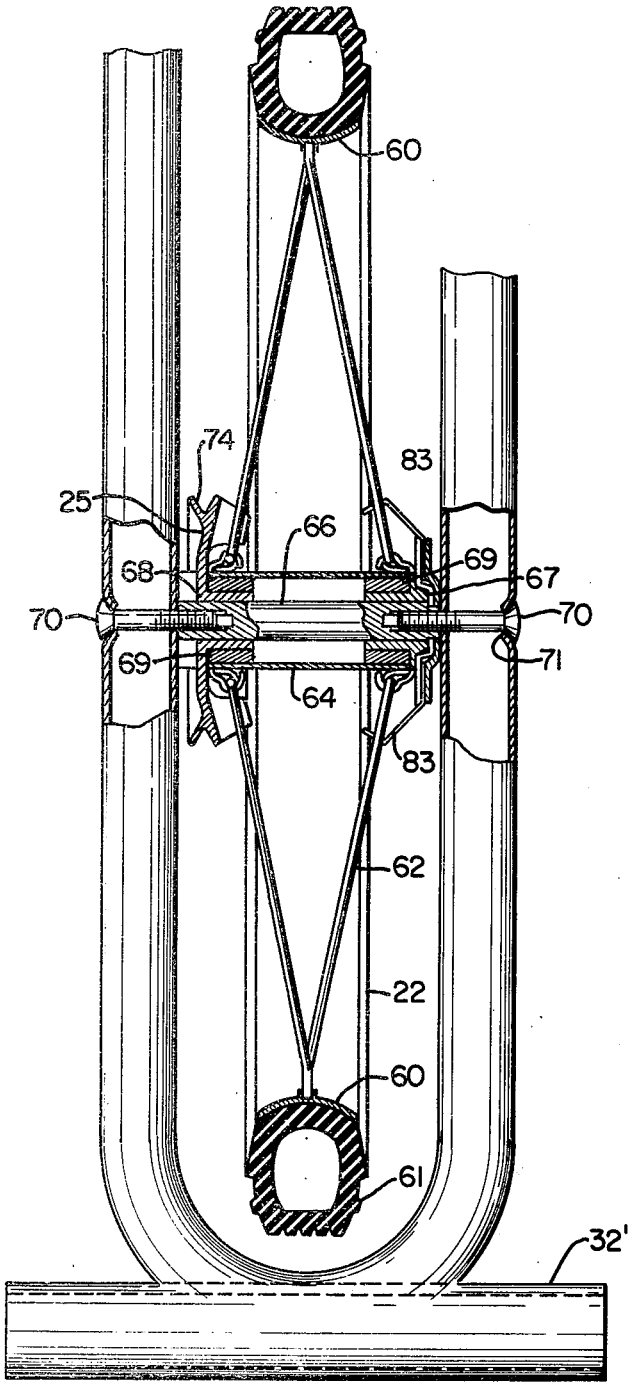
FIG. 5 is a front view enlarged and partially in section of the front standard and front wheel assembly in the preferred form of invention.
Figure 6:
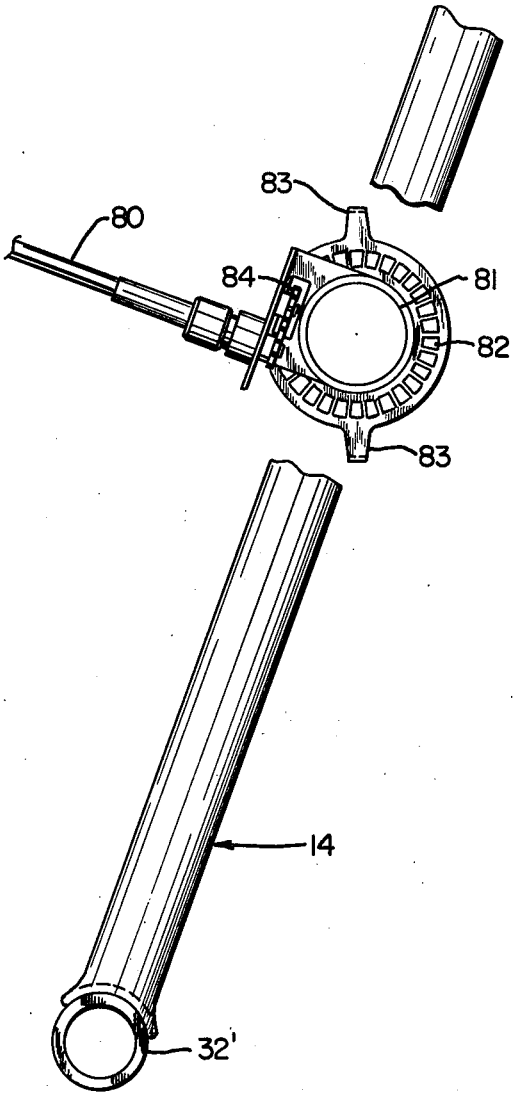
FIG. 6 is a side view with portions broken away to illustrate the speedometer mounting on the front wheel hub portion as shown in FIG. 5.

As shown in FIGS. 5 and 6, the speedometer assembly S conventionally includes a cable drive connection 80 into a carrier plate 81 on a gear drive 82 which has diametrically opposed tabs 83 projecting into the path of the spokes 62 so as to follow rotation of the wheel and to impart such rotation to the gear drive 82. In a well known manner the gear drive 82 intermeshes with one of a series of gears 84 to impart rotation to the cable drive 80 leading into the speedometer assembly.

Figure 3:
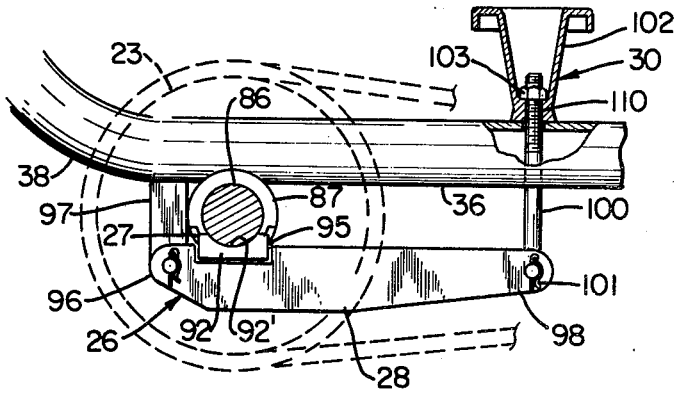
FIG. 3 is a fragmentary view, enlarged, of a braking member shown partially in section in cooperation with a portion of the pedal crank assembly in accordance with the present invention.
Figure 4:
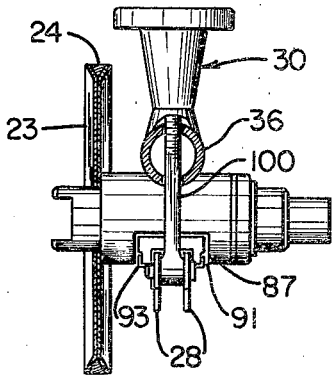
FIG. 4 is a front view of the brake member and pedal crank assembly illustrated in FIG. 3.

An important feature of the present invention resides in the cooperative disposition and relation between the pedal crank assembly and braking unit 26. As shown in FIGS. 1, 3 and 4 the pedal crank assembly 20 is comprised of a crankshaft 86 journaled in a bearing housing 87 which is affixed to the undersurface of lower closed end 38 of the intermediate frame, such as, by welding and has left and right pedal arms 88 and pedals 89 which in accordance with conventional practice are affixed to opposite ends of the crankshaft by suitable fasteners such as cap screws, not shown. The drive pulley 23 is keyed for rotation on one end of the crankshaft 86 to provide a V-shaped groove for the V belt 24. The bearing housing 87 is in the form of a relatively thick-walled sleeve which has an arcuate segment recessed as at 91 so as to expose the outer surface of the crankshaft intermediately of the bearing housing for engagement by the concave braking surface 92' of a generally saddle-shaped brake pad 92. Brake pad 92 is mounted in a retainer 93 which is of open rectangular configuration so as to expose the brake pad with its frictional braking surface 92' in facing relation to the exposed section of the crankshaft 86. The retainer 93 is mounted in aligned open slots 95 formed in the upper surface of a pair of coextensive brake arm members 28. The brake arm members correspondingly have one end 96 pivoted on either side of a stationary pivot arm 97 which projects downwardly from the lower closed end 38 of the intermediate frame 16, and opposite ends 98 of each of the brake arm members 28 are pivotally connected to one end of an eye bolt 100 which extends downwardly through the frame 16 and forms a part of the adjustable control means 30. Here the eye of the bolt 100 is aligned with openings in the opposite ends 98 of the brake arm members for insertion of a suitable fastener such as a cotter pin 101, and a similar means of connection is employed at the ends 96 of the brake arm members. The opposite end of the eye bolt 100 is threaded for insertion through a bore 110 in manual adjustment knob 102 and a nut 103 bears against a shoulder at the inner end of the threaded bore 110 and is rotated by the manual adjustment knob. It will be apparent that rotation of the knob 102 in a direction causing the bolt 100 to be advanced through the frame will cause the brake pad 92 to be urged upwardly to increase its frictional engagement with the pedal crankshaft 86 whereby to increase resistance to rotation of the crankshaft. Conversely, loosening of the knob will relieve frictional engagement of the pad against the crankshaft.

It will be noted that brake adjustment is effected at a point ahead of application of rotation by the pedal crank assembly through the drive pulley 23 into the front wheel 22. As a result the front wheel mounting is such as to be freely rotatable and impose a minimum of resistance to the application of torque by the V-belt between the drive and driven pulleys thereby avoiding the necessity of a positive drive arrangement, such as, chain drives which have been found to be somewhat noisy especially in indoor exercising apparatus. Nevertheless, the V-belt drive affords sufficient positive driving force to accurately and positively impart rotation of the pedal crank assembly into the front wheel where the speed of rotation can be accurately recorded by the speedometer.

In the novel and improved form of exerciser apparatus herein described, a unified assembly has been devised in which the user may from a seated position astride the seat portion 18 conveniently adjust the tension on the pedal crank assembly merely by reaching down and turning the control knob 102. The adjustable control for the brake unit may be calibrated with suitable indicia on the adjustment control knob 102 to permit the user to set the knob to a predetermined amount of tension or resistance. In this way, the resistance can be selectively increased as the user builds up his strength under repeated use and exercising. By placing the brake adjustment assembly so as to act directly upon the pedal crankshaft, not only is the requirement for a positive drive from the pedal crank assembly into the front wheel minimized, but the entire front wheel assembly may be highly simplified since its prime function is reduced to providing a means of sensing rotation for the speedometer assembly and providing the user or rider with more of a sense of actually riding a bicycle. For this reason, however, the outer tire 61 as well as the entire front wheel unit may be replaced by a relatively inexpensive rotating member which merely takes on the appearance of a bicycle tire. Although not shown, a suitable guard or housing may be provided over the V-belt drive; and if desired the front and rear standards 14 and 15 may be made to be adjustable in height simply by replacing same with telescoping tubular portions.

Accordingly, it is to be understood that various modifications and changes may be made in the construction and arrangement of the preferred embodiment of the present invention without departing from the spirit and scope thereof as defined by the appended claims.

What is claimed is:

1. In an exerciser apparatus wherein a stand includes front and rear base support members and a frame suspended between said base support members having a lower closed end portion and forwardly and rearwardly divergent legs inclining upwardly in opposite directions away from said lower closed end portion for connection to said front and rear base support members, respectively, the combination therewith comprising:

a pedal crank assembly including a bearing housing and a crankshaft journaled in said bearing housing adjacent to the lower closed end of said frame, a rotatable wheel member disposed on said front base support member, and a rear seat portion mounted on said rearwardly divergent leg of said frame, drive means for imparting the rotation of said pedal crank assembly to said front wheel, an adjustable tension control assembly associated with said pedal crank assembly including a brake pad frictionally engaging said crankshaft, a lever arm member pivotally supporting said brake pad for frictional engagement with said crankshaft through a recess in said bearing housing, a pivotal support member pivotally securing one end of said lever arm member to said frame adjacent to one side of said bearing housing, said lever arm member extending from said pivotal support member across said bearing housing and along one of said forwardly and rearwardly divergent legs in substantially parallel relation thereto and terminating in a free end adjacent to said one of said forwardly and rearwardly divergent legs, the distance between said free end of said lever arm member and said bearing housing being greater than the distance between said bearing housing and said pivotal support member, and tension adjustment means extending through said one of said forwardly and rearwardly divergent legs and connected to said free end of said lever arm member at a point spaced above said bearing housing, said tension adjustment means including manual adjustment means to permit the operator of said exerciser apparatus to adjustably control the movement of said free end of said lever arm toward and away from said one of said forwardly and rearwardly divergent legs to adjustably control the frictional resistance of said brake pad to rotation of said crankshaft.

2. In an exerciser apparatus according to claim 1, said brake pad including a concave frictional brake surface partially encircling a peripheral surface portion of said pedal crankshaft.

3. Exercising apparatus according to claim 1, said front standard being in the form of a generally U-shaped tubular member having spaced parallel, upwardly extending legs, and a curved portion interconnecting said legs and a handlebar unit forming an upward continuation of each leg on said front standard, said curved portion being mounted to a front base member.

4. Exercising apparatus according to claim 1, said drive means being defined by a V-belt composed of rubber or rubber-like material.

5. In an exerciser apparatus acording to claim 1, said tension adjustment means including a connecting link pivotally connected to the free end of said brake arm member for extension through an opening in said frame, and a manual adjustment knob on one end of said link member extending through said frame opposite to its pivotal connection to said brake arm member.

6. In an exerciser apparatus according to claim 1, said brake pad including a concave frictional brake pad mounted in a recess in said brake arm member and partially encircling a peripheral surface portion of said pedal crankshaft.

7. Exercising apparatus according to claim 1 wherein said tension adjusting means passes through a bore in said forwardly diverging leg and has a threaded end portion and an adjustable screw fastener operative to move said threaded end portion, said second end of said lever responding to the movement of said tension adjusting means to adjust the force on said friction pad.

8. In an exerciser apparatus according to claim 1, said rotatable wheel member including a pulley member drivingly connected thereto, said crankshaft having a drive pulley keyed for rotation thereon, and said drive means defined by an endless, flexible power transmission belt member drivingly interconnected to said drive and driven pulleys to impart the rotation of said crankshaft to said rotatable wheel member.

9. An exerciser apparatus adapted to simulate a bicycle comprising:

a stand including front and rear standards having front and rear ground-engaging pads, and an intermediate, generally U-shaped frame having a lower closed end portion and forwardly and rearwardly divergent legs inclining upwardly in opposite directions away from said lower closed end portion for connection to said front and rear standards, respectively;

an adjustable seat mounted on the rearward end of said intermediate frame;

a front wheel rotatably mounted to said front standard, said front standard being in the form of a generally U-shaped tubular member having spaced parallel upwardly extending legs, and a handlebar unit forming an upward continuation of each leg on said front standard and a pulley member drivingly connected to said front wheel, said front wheel mounted between the legs of said front standard;

a pedal crank assembly including a bearing housing affixed adjacent to the lower closed end of said intermediate frame in spaced relation below said seat, and a crankshaft journaled in said bearing housing having a drive pulley keyed for rotation on said crankshaft;

an endless flexible V-belt member drivingly interconnecting said drive and driven pulleys to impart rotation of said pedal crankshaft to said front wheel;

an adjustable tension control assembly associated with said pedal crank assembly including a brake pad frictionally engaging said crankshaft, a lever arm member pivotally supporting said brake pad for frictional engagement with said crankshaft through a recess in said bearing housing, a pivotal support member pivotally securing one end of said lever arm member to said frame adjacent to one side of said bearing housing, said lever arm member extending from said pivotal support member across said bearing housing and along one of said forwardly and rearwardly divergent legs in substantially parallel relation thereto and terminating in a free end adjacent to said one of said forwardly and rearwardly divergent legs, the distance between said free end of said lever arm member and said bearing housing being greater than the distance between said bearing housing and said pivotal support member, and tension adjustment means extending through said one of said forwardly and rearwardly divergent legs and connected to said free end of said lever arm member at a point spaced above said bearing housing, said tension adjustment means including manual adjustment means to permit the operator of said exerciser apparatus to adjustably control the movement of said free end of said lever arm toward and away from said one of said forwardly and rearwardly divergent legs to adjustably control the frictional resistance of said brake pad to rotation of said crankshaft.

10. An exerciser apparatus according to claim 9, including a speedometer assembly adapted to sense the speed of rotation of said front wheel.

11. An exerciser apparatus according to claim 9, said rear standard inclining downwardly and rearwardly away from said intermediate frame and terminating in a transverse brace having spaced ground-engaging pads thereon.

12. An exerciser apparatus according to claim 9, said front U-shaped tubular member inclining forwardly and downwardly away from said intermediate frame and terminating at its lower end in a curved portion interconnecting said parallel legs, said curved portion mounted to a transverse brace having spaced ground-engaging pads thereon.

13. An exerciser apparatus according to claim 9, a support shaft extending between said parallel legs to rotatably support said front wheel thereon, said front wheel having a hub spaced in outer concentric relation to said shaft.

* * * * *